US005970545A

United States Patent [19]

Garman et al.

[11] Patent Number: 5,970,545

[45] Date of Patent: Oct. 26, 1999

[54] SUPPORT APPARATUS FOR USE ON BEDS

[75] Inventors: David Edmund Talbot Garman, Llandrindid Wells; Richard Edmond Fletcher, Leominster, both of United Kingdom

[73] Assignee: Mangar International Limited, United Kingdom

[21] Appl. No.: 08/952,642

[22] Filed: Nov. 17, 1997

Related U.S. Application Data

[63] Continuation of application No. PCT/GB96/01181, May 17, 1996.

[30] Foreign Application Priority Data

May 26, 1995 [GB] United Kingdom ..... 9510717
Aug. 11, 1995 [GB] United Kingdom ..... 9516484

[51] Int. Cl.[6] ..... A47C 20/08

[52] U.S. Cl. ..... 5/615; 5/634; 5/632; 5/644; 5/655.3

[58] Field of Search ..... 5/634, 633, 644, 5/655.3, 615, 632, 630, 711, 713

[56] References Cited

U.S. PATENT DOCUMENTS

| | | | |
|---|---|---|---|
| 818,321 | 4/1906 | Whall | 5/711 |
| 3,121,884 | 2/1964 | Emery | 5/634 |
| 3,378,861 | 4/1968 | Lousberg | 5/633 X |
| 4,550,901 | 11/1985 | Muchisky et al. | 5/630 |
| 5,170,522 | 12/1992 | Walker | 5/615 |
| 5,311,625 | 5/1994 | Barker et al. | 5/615 |
| 5,497,520 | 3/1996 | Kunz et al. | 5/644 X |
| 5,528,783 | 6/1996 | Kunz et al. | 5/634 |

FOREIGN PATENT DOCUMENTS

| | | | |
|---|---|---|---|
| 5-56828 | 3/1993 | Japan | 5/711 |
| 96/37175 | 11/1996 | WIPO . | |

*Primary Examiner*—Terry Lee Melius
*Assistant Examiner*—Rodrigo J. Morales
*Attorney, Agent, or Firm*—Neil F. Markva

[57] ABSTRACT

Backrest support apparatus comprising an inflatable flexible bag structure which comprises two hollow limbs (11, 12) configured and connected at a junction or tethered to assume a stable configuration when fully inflated, and to collapse to a substantially planar configuration in which one limb (11) at least partially overlies the other (12) when the structure is deflated.

16 Claims, 6 Drawing Sheets

SUPPORT APPARATUS FOR USE ON BEDS

This is a continuation of the International patent application PCT/GB96/01181, filed May 17, 1996 designating the United States of America, which is based upon GB 9510717.3, filed May 26, 1995 and GB 95106484.4, filed Aug. 11, 1995.

This invention concerns an inflatable patient support apparatus for use, for example, on beds.

A form of support apparatus which serves as a backrest and comprises a backrest panel capable of being raised from a horizontal condition to an inclined position by a pneumatically inflatable bag structure, for raising a person lying on a bed from a prone position to a sitting up in bed position is disclosed in U.S.A. 3606623 by J. R. Aymar. In this apparatus the backrest panel is rigid, and the bag structure comprises a plurality of approximately wedge shaped bags which are secured together and are disposed between rigid upper and lower boards which are pivotally connected so that the upper board provides the backrest panel and is stabelized by the pivotal connection, e.g. during inflation and deflation to vary the angle included between the boards. The upper surface of the backrest panel is thus unyielding and moves about a fixed pivot axis.

In use the known backrest apparatus can give rise to considerable discomfort for its users, because, for example, a thick resilient mattress is required above the rigid plate, so that the axis of the person's hips is spaced above the pivot axis of the backrest which generates an uncomfortable, and sometimes painful, conflict of. geometry during lifting which can only be partially mitigated by increasing the comformability of the mattress. As well as this problem of user discomfort, the apparatus imposes structurally harmful loads upon the mattress by bending it about a fixed axis at a small radius of curvature, thus giving rise to the problem of damage to the mattress and high replacement costs. Said apparatus is also heavy and unsuitable for use on top of a mattress.

In GB 2 231 790A there is disclosed a patient support apparatus which can be laid on a bed and which provides a frameless inflatable bag structure. In this structure various individual bags are secured upon a flexible bed cover. The bags are individually inflatable to serve as cushions to support various parts of a patient, and include an optional backrest cushion and an optional knee cushion. Each cushion comprises a single bag and its shape and size is determined by the inflated shape and volume of the bag. Because of the necessarily large volumes of the bags, the time taken to inflate and deflate the bags is very great, unless a high capacity compressed air supply is available e.g. from an industrial size compressed air installation. This presents a serious problem to persons wishing to employ such an apparatus for domestic use.

An object of the present invention is to enable these problems to be avoided or reduced.

The present invention generally provides a patient support apparatus comprising a frameless inflatable flexible bag structure which comprises a patient support limb connected at a junction to a jacking limb, said limbs being configured and connected to assume a stable load bearing inverted V-shaped configuration in which the patient support limb is propped-up by the jacking limb when fully inflated, and to collapse to a substantially planar configuration in which the patient support limb at least partially overlies the jacking limb when the flexible structure is deflated.

More particularly, and with reference to GE 2 231 790A the limbs can thus be made relatively thin in relation to their length and breadth so as to have only a relatively small volume, and the entire volume of the bag structure can be made much less than the overall space cccupied over the bed by the apparatus, thus reducing the volume of air required to such as can be provided in a reasonable amount of time by a portable air pump unit.

According to one form of the present invention there is provided a back support apparatus comprising a backrest panel capable of being raised from a horizontal condition to an inclined position by a pneumatically inflatable bag structure, for raising a person lying on a bed from a prone position to a sitting-up position in bed characterized in that the backrest panel is provided by a flexible panel surface of the bag structure, and in that the bag structure comprises a backrest limb connected at a junction to a jacking limb, said limbs being configured and connected to assume a stable load bearing inverted V-shaped configuration when fully inflated, and to collapse to a substantially planar configuration in which the backrest limb at least partially overlies the jacking limb when the flexible structure is deflated.

The invention employing a volume reducing form of bag structure further particularly provides a leg support apparatus comprising a legrest panel capable of being raised from a horizontal condition to an inclined position by a pneumatically inflatable bag structure, for raising the legs of a person lying on a bed from a prone position to a raised position characterized in that the legrest panel is provided by a flexible panel surface of a legrest limb of the bag structure; and in that the legrest limb is connected at a junction to a jacking limb, said limbs being configured and connected to assume a stable load bearing inverted V-shaped configuration when fully inflated, and to collapse to a substantially planar configuration in which the legrest limb at least partially overlies the jacking limb when the flexible structure is deflated.

The bag structure may comprise a single bag providing both limbs. Alternatively, each limb may comprise a single bag. The limbs are preferably simultaneously inflatable via a single air inlet or common supply line.

The junction may be formed so as to determine the angle between the limbs when fully inflated.

The ends of the limbs remote from the junction are preferably linked or connected by flexible inelastic tethering means to limit, maintain or further determine said angle.

The junction may be of pivotal form with the maximum angle between the limbs, when inflated, being limited by said tethering means.

The invention further provides a patient support apparatus comprising an inflatable flexible bag structure which comprises a hollow patient support limb and a jacking limb having one end portion connected to the patient support limb at a junction so as to serve as a pivot during inflation and deflation; wherein the lower end portion of each of the limbs, which portions are remote from the connection between the limbs, are linked to each other by tethering means, so that the jacking limb is caused to fold between its ends during deflation.

A further problem has arisen in that the aforementioned bag structure, when repeatedly inflated and deflated, tends to "walk" on the bed, and in order to solve this problem the apparatus preferably further comprises basal spacing means extending beyond the connection between the jacking limb and the tethering means in a direction away from the patient support limb.

The jacking limb is preferably configured to taper e.g. so as to increase in thickness from a mid-portion or the lower end portion to the other end portion connected to the patient support limb.

Each of the limbs may comprise an individual bag, which bags are preferably pneumatically linked for simultaneous inflation.

The spacing means preferably comprises longitudinal battens extending within extensions of the tethering means, and, optionally in some embodiments, a cross-batten transverse to the ends of the longitudinal battens remote from the jacking limb.

The lower end port on so the patient support limb preferably includes a transverse narrow cushion chamber of lesser inflated thickness than the remainder of the limb or at least a main chamber of the limb.

In all embodiments each of the limbs preferably comprises two substantially rectangular panels connected internally of the limb either directly by bonding or by internal flexible inelastic links.

The flexible links are preferably in the form of elongate inelastic webs bonded to the panels.

The links may be elongate and extend across or along most of the interior of each limb, or the flexible links may be in the form of bands, preferably arranged in rows across or along the limbs, each band being bonded to extend between the panels.

Each limb is preferably formed from a sheet of impervious, inelastic-flexible material, e.g. a polymer coated woven fabric, folded to provide the two panels, with the fold situated at one end, so that said end is seam-free, flexible and of minimal thickness.

The apparatus may be provided with a flexible tie to tether the apparatus to a mattress.

The leg support apparatus is preferably attached, preferably releasably and preferably adjustably, to the backrest limb or the tethering means of the backrest support apparatus.

The inflatable structures of the back support apparatus and the leg support apparatus are preferably selectively inflatable and deflatable independently of each other, by means of an inflation and control system comprising a portable electrically operated pump unit remotely controlled by means of a hand operated unit.

The invention will be described further, by way of example, with reference to the accompanying diagrammatic drawings wherein.

Figure 4:
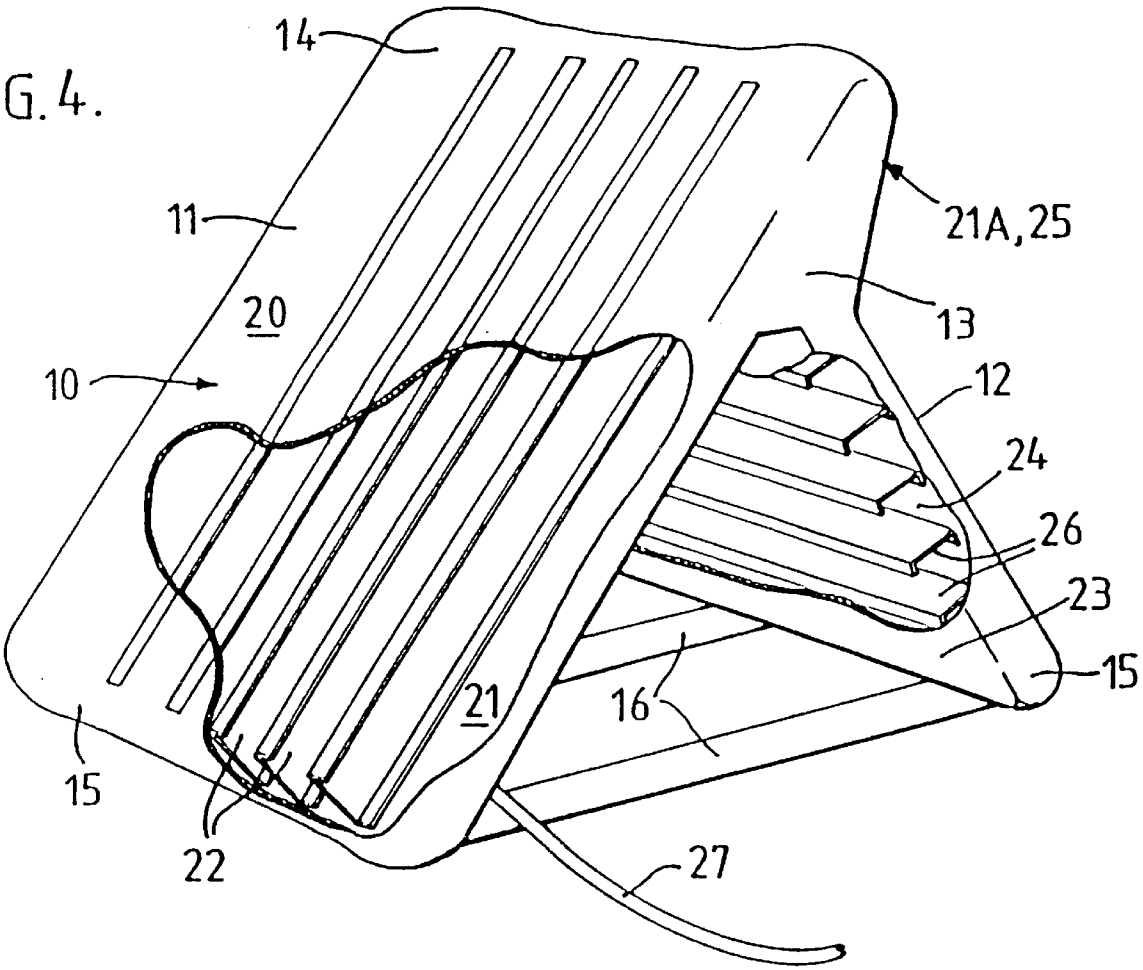
FIG. 4 is a perspective, part sectional, view of the back support apparatus in an inflated condition.
Figure 5:
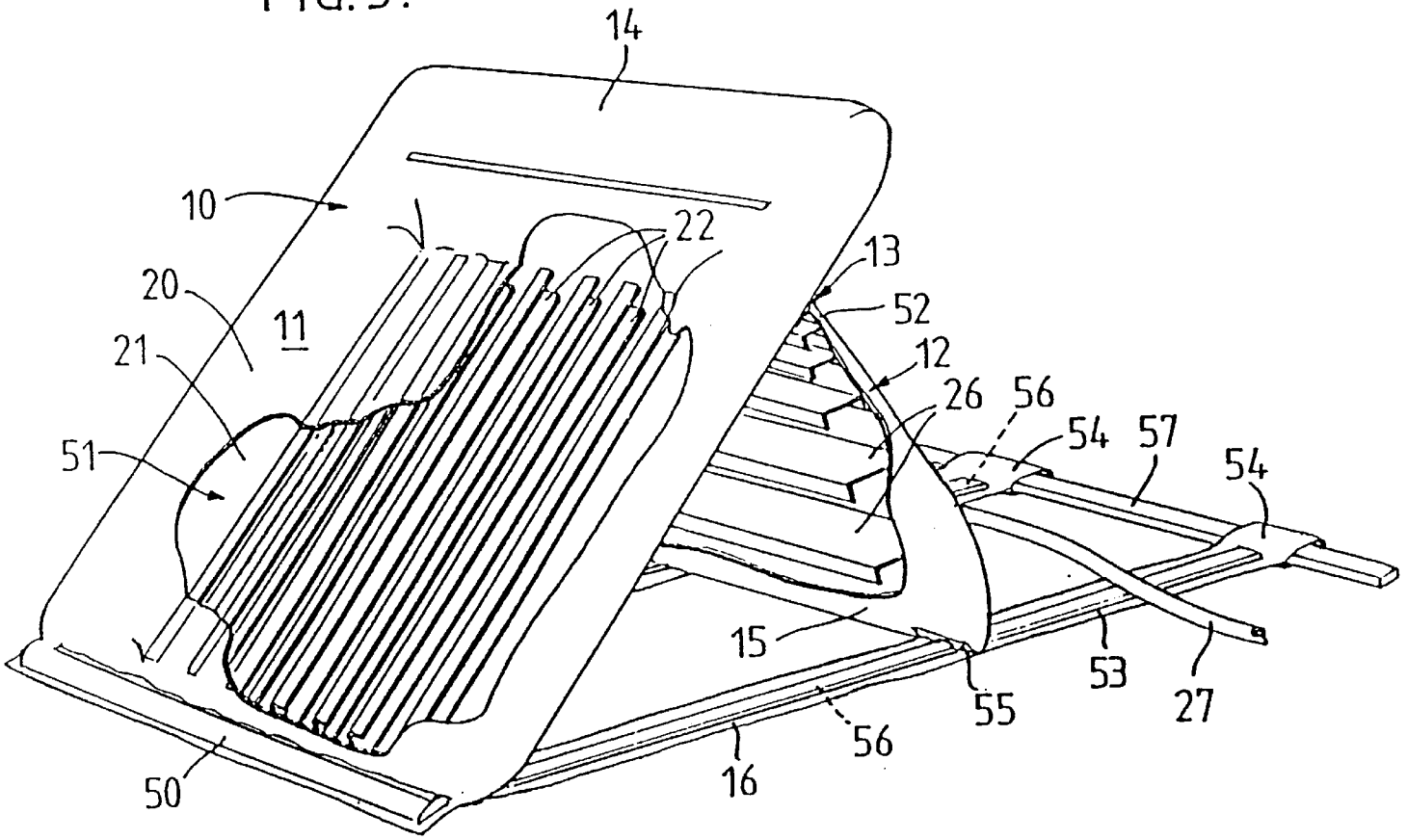
Figure 6:
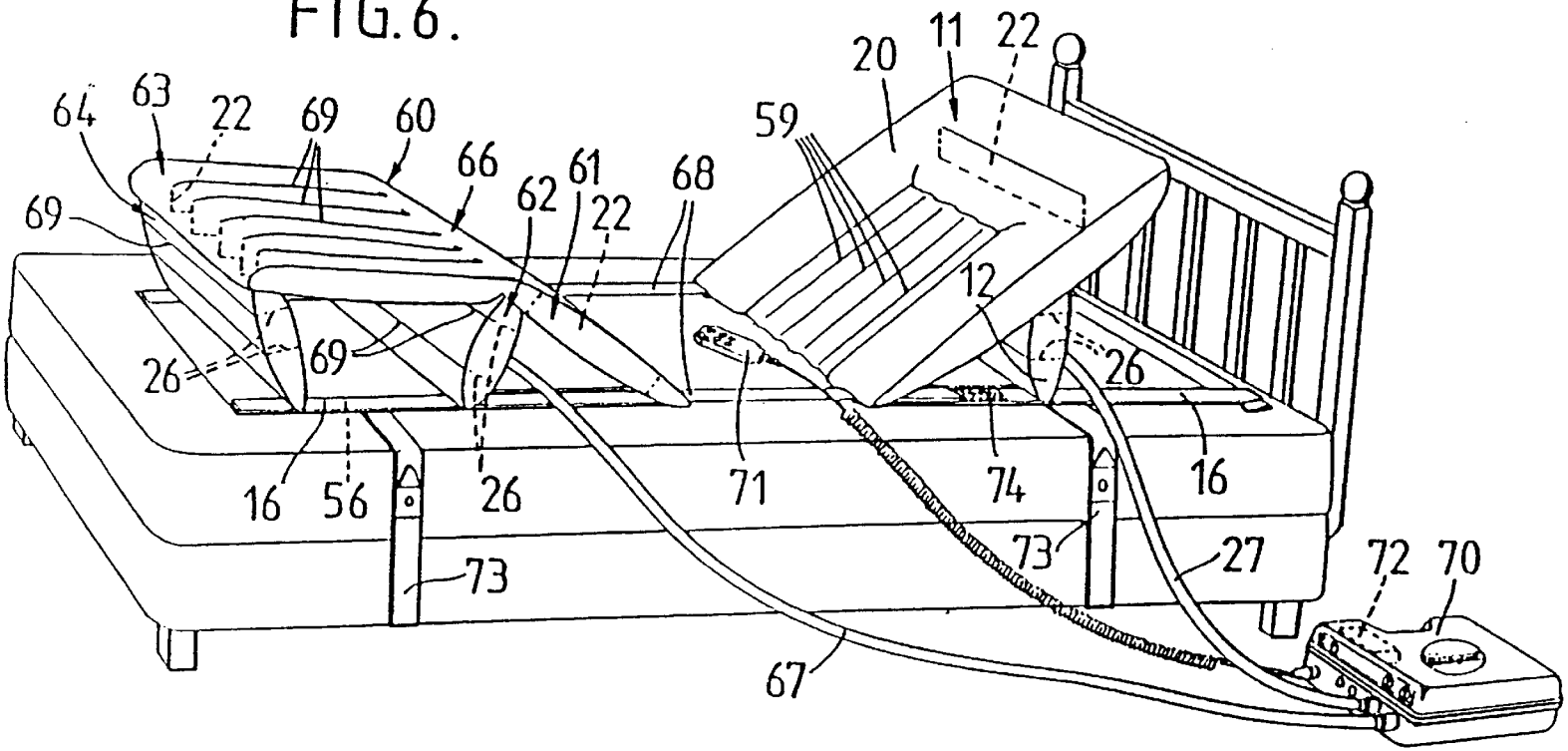

FIG. 5 is a view similar to FIG. 4 showing a second embodiment of the back support apparatus, and FIG. 6 is a perspective view of further embodiments of the apparatus of the invention including a third embodiment of the back support apparatus and an embodiment in the form of a leg support apparatus, together with optional adjustable connecting means connecting the back support apparatus and the leg support apparatus.

As shown in FIGS. 1 to 4, the first embodiment of the back support apparatus comprises a frameless pneumatically inflatable bag structure 10 which incorporates a hollow patient support or backrest limb 11 and a rear jacking limb 12. The two limbs merge at a junction 13 a short way below the upper end portion 14 of the backrest limb 11 so that the device, when inflated has a shape generally that of a Y or V (or even a lopsided T) and is used in a condition in which said shape is inverted with the free ends 15 of the limbs 11,12 lowermost so that the limbs descend from the junction to assume an inverted-V-shaped configuration in which the included angle is determined by the junction, and, for added stability, the free ends 15 are linked by tethering means comprising bands 16 of flexible inelastic material to limit said angle.

Referring to FIG. 4, the backrest limb 11 comprises a front panel 20 which extends from top to bottom of the limb, a rear panel 21 which is interrupted at the junction, and a row of internal webs 22, each of which extends longitudinally of the limb 11 and is connected to the panels 20,21 to limit the separation thereof when the device is inflated. The jacking limb 12 similarly comprises a front panel 23 which faces generally towards the panel 21 and extends up to the junction 13 and a rear panel 24 having an upper part 25, which part 25 is inclined to the remainder, extends upwards from the junction 13 to serve as a rear upper panel 21A for the backrest limb 11, and is connected to the upper portions of the webs 22. The panels 23 and 24 are connected by a row of internal webs 26, each web 26 extending transversely of the jacking limb 12.

An air supply line 27 is connected to the rear of the limb 11 (or the limb 12).

Figure 1:
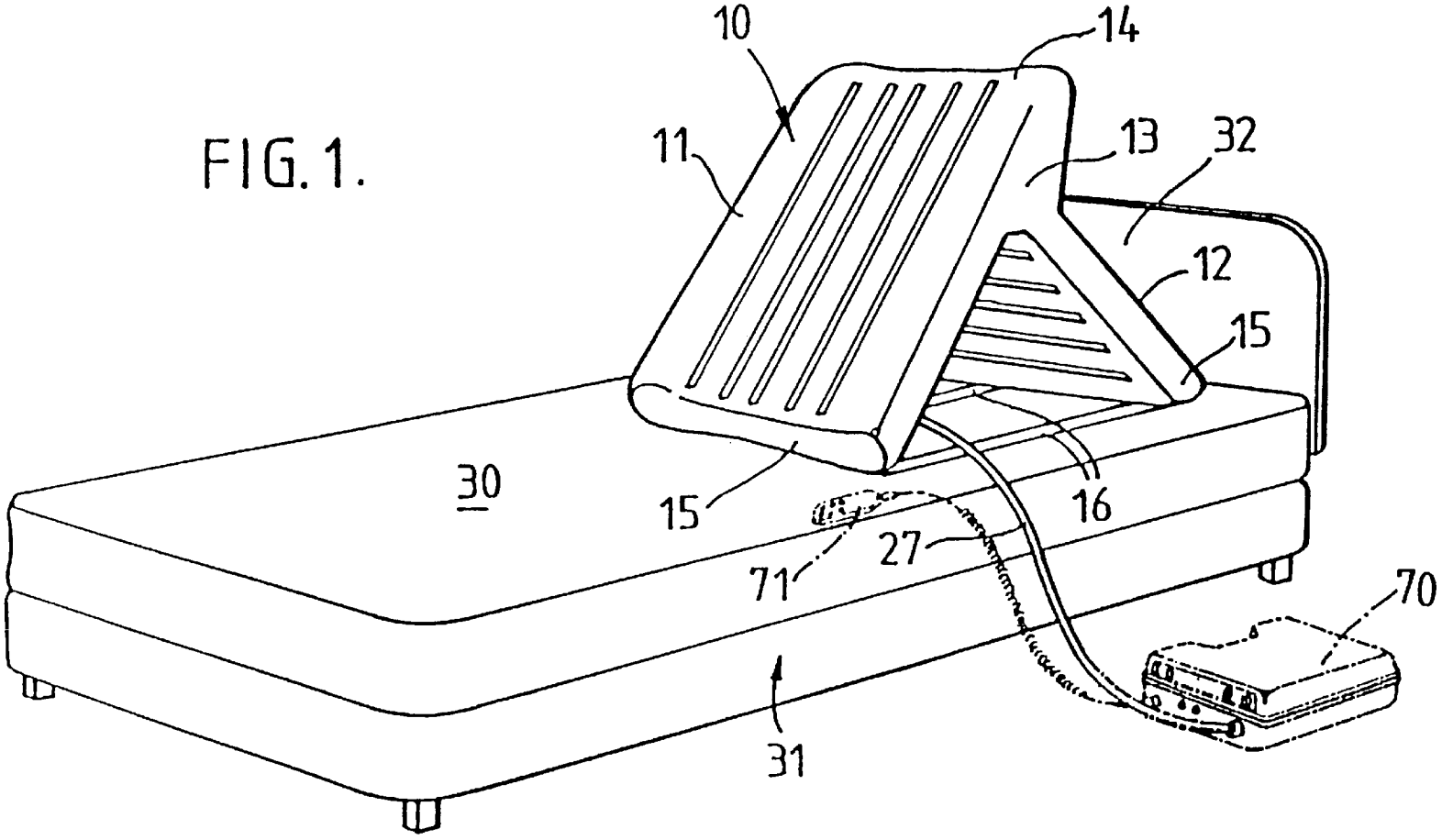
FIG. 1 is a perspective view of a first embodiment of patient support apparatus of the invention in the form of a back support apparatus, inflated, and, in situ, upon a bed.
Figure 2:
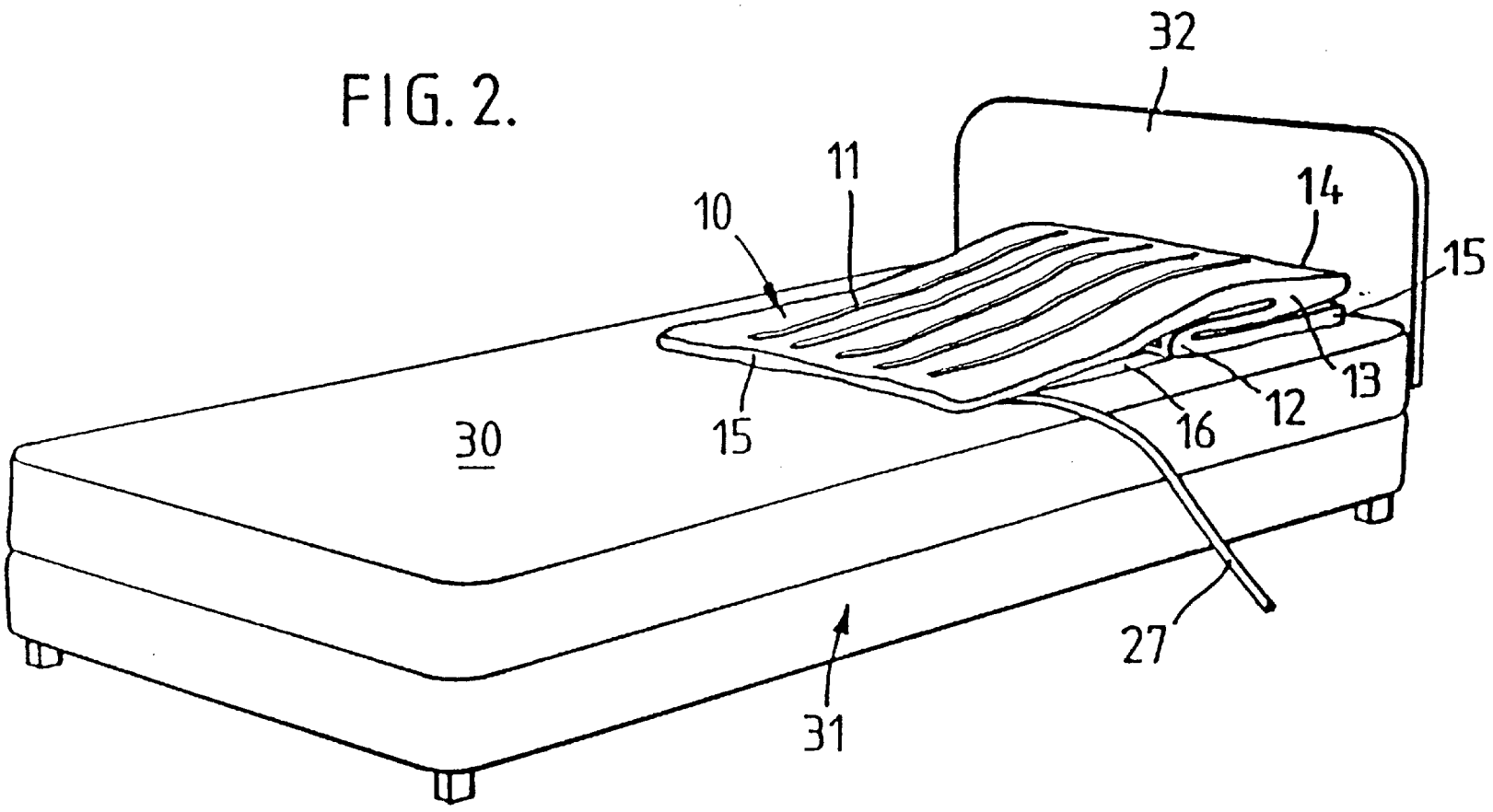
FIG. 2 is a perspective view of the apparatus in a substantially deflated condition.
Figure 3:
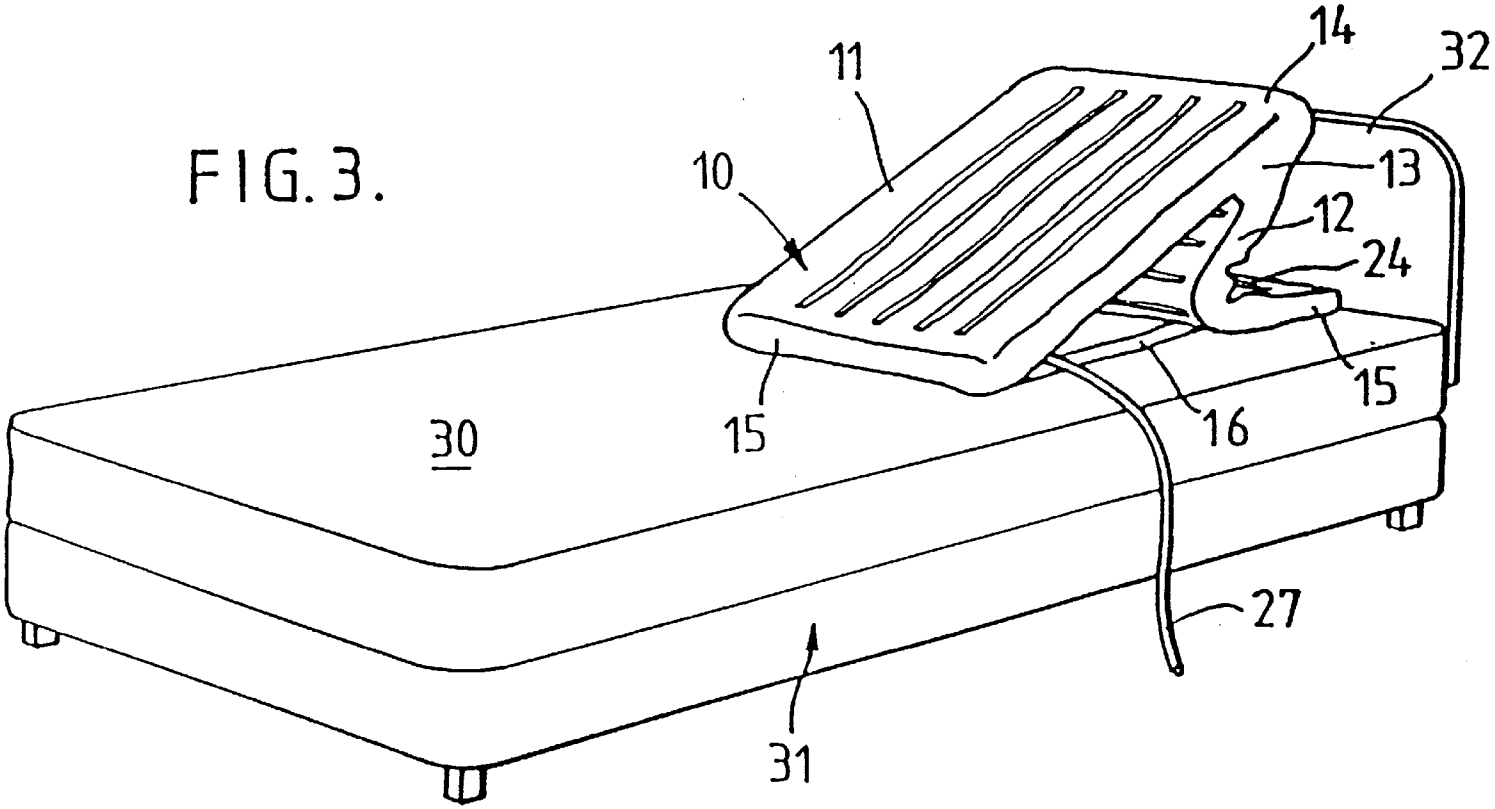
FIG. 3 shows the back support apparatus partially deflated.

Referring to FIGS. 1 to 3, in use, the apparatus is simply placed on a mattress 30 of a bed 31 so that the backrest limb 11 is laid flat with its upper end portion 14 adjacent the head 32 of the bed, and the jacking limb 12 is folded beneath the upper end portion of the limb 11, as indicated in FIG. 2. From this condition, upon inflation via the line 27, the apparatus assumes the configuration shown in FIG. 1. During inflation and deflation of the apparatus it passes through an intermediate condition in which the backrest limb 11 remains substantially straight (subject to the disposition and magnitude of the loads imparted to it by a person reclining thereon) and the jacking limb 12 is partially folded to assume an S-shape and provides resilient support for the limb 11, as indicated in FIG. 3.

In order to provide cushioning for a person's thorax and a slightly raised resilient pillow, a small amount of air is preferably left in the apparatus when the backrest limb has been lowered, so that the device remains slightly pressurized, as shown in FIG. 2.

Referring to FIG. 5 (in which the same reference numbers appearing in FIGS. 1 to 4 are used to denote the same or functionally equivalent parts of the apparatus), the second embodiment of the apparatus differs from that shown in FIGS. 1 to 4 primarily in that:

(a) The hollow backrest limb 11 has a narrow transverse cushion chamber 50 pneumatically connected to the main chamber 51;

(b) the rear jacking limb 12 tapers in thickness from a maximum adjacent to its lower free end 15 to a minimum at its upper end portion 52;

(c) the limbs 11 and 12 are formed as separate bags which are pneumatically connected;

(d) the upper end portion 52 is thin where it is connected to the limb 11 to form the junction 13, so that said junction 13 or at least the portion 52 thereof serves as a hinge during inflation and deflation;

(e) the tethering bands 16 are hollow, are provided with rearwardly directed extensions 53 and have terminal transversely opening loops 54; and (f) the connections 55 between the bands 16 and said end 15 are such that said limb 12 can pivot during inflation and deflation about said end 15 or the connections.

Additionally, each hollow band 16 contains an elongate batten 56 (which may be removable, e.g. by twisting the loop 54 to expose the end of the batten 56), and a transverse batten 57 extends through the loops 54. In use, the batten 57 abuts the headboard 32 (not shown in FIG. 5) so that the battens 56 and 57 serve as basal spacing means to space the inflatable bag structure 10 from the headboard 32. The battens and bands 16 also serve as basal spacing means to maintain the spacing between the lower ends of the limbs 11 and 12.

The form of construction also gives a reduction of internal volume, thus reducing inflation time and demand on the air supply system.

The third embodiment of the back support apparatus is similar generally to the second embodiment, and in FIG. 6 the same reference numbers are again used to denote the same or functionally equivalent parts. In the third embodiment the chamber 50 is omitted, and along the lines 59 the front panel 20 is directly bonded to the rear panel without the webs 22 to further reduce the internal volume of the backrest limb.

FIG. 6 also shows a leg support apparatus which comprises a pneumatically inflatable bag structure 60 which incorporates a leg support limb 61, a leg jacking limb 62, a foot support limb 63 and a foot jacking limb 64 all of which limbs are inflatable by a single air supply line 67 and have internal webs, similar to the webs 22,26, to connect their major panels internally, e.g. along the lines 69 indicated in FIG. 6. The limbs 61 and 63 are formed as a single bag with a flexible intermediate hinge portion 66, and the leg jacking limb 62 is connected to the hinge portion 66.

The lower ends of the limbs 61,62 and 64 are attached to tethering means again comprising bands 16, which bands have extensions 68 which extend to connect with the back support apparatus and a connection means, e.g. comprising "Velcro" tape strips 74, is provided to connect the extensions 68 to the bands 16 below the backrest limb 11. The bands 16 may contain battens 56 to serve as basal spacing means to maintain the spacing of the connections between the bands 16 and the limbs 61, 62 and 64.

FIG. 6, also shows an example of a portable air pump unit 70 of two outlet form, which is remotely controllable by a hand control unit 71 and to which the lines 27 and 67 are connected. A similar but single outlet form of the unit 70 and the unit 71 may be employed with the other embodiments as indicated in broken lines in FIG. 1. The unit contains and is powered by an electrically rechargeable battery 72 (indicated in broken lines).

In all embodiments of the apparatus, a flexible tie 73 may be attached to the bands 16 to encircle the bed (or mattress) to hold the apparatus on the bed, as shown in FIG. 6.

The embodiment shown in FIGS. 1 to 4 may be modified to incorporate any part or parts of the second or third embodiment.

The device may be covered, e.g. by a sheet, overlay or mattress.

The invention is not confined to details of the foregoing examples and many variations and modifications are possible within the scope of the invention. For example, each limb may comprise a bag having an air inlet, the bags being joined mechanically at the junction.

The limbs may be of other relative lengths and proportions, and the position of the junction may be varied e.g. moved downwards to nearer to the center of the backrest limb. The angle included between the limbs may be varied.

The invention further provides and includes within its scope pneumatic support apparatus having any novel feature, component, part or function disclosed herein or in the drawings and any mechanical or functional equivalent or combination thereof.

We claim:

1. Patient support apparatus comprising:

(a) a frameless inflatable flexible bag structure including a patient support limb connected at a junction to a jacking limb, (b) said limbs being configured and connected to assume a stable load bearing inverted V-shaped configuration in which the patient support limb is propped-up by the jacking limb when fully inflated, and to collapse to a substantially planar configuration in which the patient support limb at least partially overlies the jacking limb when the flexible structure is deflated; and (c) each of the limbs includes an outer end portion remote from the junction and two substantially rectangular panels connected internally of the limb by internal flexible inelastic links, and (d) the flexible links include elongate inelastic webs bonded to the panels.

2. Apparatus as claimed in claim 1 wherein the structure comprises a single bag providing both limbs.

3. Apparatus as claimed in claim 1 wherein the outer end portion of the limbs remote form the junction are linked by flexible inelastic tethering means.

4. Patient support apparatus comprising:

(a) an inflatable flexible bag structure including a hollow patient support limb and a jacking limb having one end portion connected to the patient support limb to form a connection at a junction so as to serve as a pivot during inflation and deflation;

(b) each said limb including a lower outer end portion which is remote from said junction, (c) said lower outer end portions being linked to each other by tethering means for causing the jacking limb to fold between its lower end portion and the junction during deflation, and (d) each of the limbs comprises two substantially rectangular panels connected internally of the limb by internal flexible inelastic links, and (e) the flexible links include elongate inelastic webs bonded to the panels.

5. Apparatus as claimed in claim 4 further including basal spacing means extending beyond said connection between the jacking limb and the tethering means.

6. Apparatus as claimed in claim 1 or 4 wherein said internal flexible links are arranged in rows across the limbs, and are bonded to extend between said panels of the bag structure.

7. Apparatus as claimed in claim 6 wherein each limb is formed from a sheet of impervious, inelastic-flexible material, folded to provide a fold situated at a free end of said outer end portion, so that said free end is seam-free, flexible and of minimal thickness.

8. Back support apparatus comprising:

(a) a pneumatically inflatable bag structure and backrest panel means for being raised from a horizontal condition to an inclined position by said pneumatically inflatable bag structure, (b) said backrest panel means being effective to raise a person lying on a bed from a prone position to a sitting-up position, (c) said backrest panel means including a flexible panel surface of a backrest limb of the bag structure, (d) said backrest limb being pneumatically connected at a junction to an inflatable jacking limb, (e) said backrest and jacking limbs each having an outer end portion remote from said junction and being structurally connected to assume a stable load bearing inverted V-shaped configuration when said limbs are fully inflated, and to collapse to a substantially planar configuration in which the backrest limb at least partially overlies the jacking limb when said limbs are deflated, and (f) tethering means connected to said outer end portions to limit movement of said outer end portions away from each other.

9. Apparatus as claimed in claim 8 further including an attached inflatable leg support apparatus.

10. Leg support apparatus comprising:

(a) legrest panel means for being raised from a horizontal condition to an inclined position by a pneumatically inflatable bag structure, (b) said legrest panel means being effective to raise a person's legs on a bed from a prone position to a raised position, (c) said legrest panel means including a flexible panel surface of an inflatable legrest limb of the bag structure, (d) said legrest limb being pneumatically connected at a junction to an inflatable jacking limb, (e) said legrest and jacking limbs each having an outer end portion remote from the junction a being structurally connected to assume a stable load bearing inverted V-shaped configuration when said limbs are fully inflated, and to collapse to a substantially planar configuration in which the legrest limb at least partially overlies the jacking limb when said limbs are deflated, and (f) tethering means connected to said outer end portions to limit movement of said outer end portions away from each other.

11. Support apparatus comprising:

(a) back support apparatus, leg support apparatus and flexible connection means attaching them together, (b) said back support apparatus including a fist pneumatically inflatable bag structure and backrest panel means for being raised from a horizontal condition to an inclined position by said pneumatically inflatable bag structure, (c) said backrest panel means being effective to raise a person lying on a bed from a prone position to a sitting-up position, (d) said backrest panel means including a flexible panel surface of a backrest limb of the first bag structure, (e) said backrest limb being pneumatically connected at a backrest junction to an inflatable backrest jacking limb, (f) said backrest and backrest jacking limbs each having an outer end portion remote from said backrest junction and being structurally connected to assume a stable load bearing inverted V-shaped configuration when said limbs are fully inflated, and to collapse to a substantially planar configuration in which the backrest limb at least partially overlies the backrest jacking limb when said limbs are deflated, (g) said leg support apparatus including legrest panel means for being raised from a horizontal condition to an inclined position by a second pneumatically inflatable bag structure, (h) said legrest panel means being effective to raise the person's legs from a prone position to a raised position, (i) said legrest panel means including a flexible panel surface of an inflatable legrest limb of the second bag structure, (j) said legrest limb being pneumatically connected at a legrest junction to an inflatable legrest jacking limb, (k) said legrest and legrest jacking limbs each having an outer end portion remote from the legrest junction and being structurally connected to assume a stable load bearing inverted V-shaped configuration when said limbs are fully inflated, and to collapse to a substantially planar configuration in which the legrest limb at least partially overlies the legrest jacking limb when said limbs are deflated, and (l) tethering means connected to said outer end portions of said backrest limb, backrest jacking limb, legrest limb and legrest jacking limb, to limit movement of said outer end portions away from each other.

12. Apparatus as claimed in claim 10 wherein the leg support apparatus includes a foot support limb connected to the leg support limb by a hinge portion and further supported by a foot jacking limb.

13. Apparatus as claimed in claim 11 further including an inflation and control system comprising an electrically operated pump unit which is remote controlled by a hand operated unit for selectively inflating and deflating said backrest support apparatus and said leg support apparatus (60).

14. Patient support apparatus comprising:

(a) frameless inflatable flexible bag means including an inflatable patient support limb pneumatically connected at a junction to an inflatable jacking limb, (b) means for inflating said limbs, (c) said support and jacking limbs having outer end portions and being structurally connected at said junction to assume a stable load bearing inverted V-shaped configuration in which the patient support limb is propped-up by the jacking limb when said limbs are fully inflated, and to collapse to a substantially planar configuration in which the patient support limb at least partially overlies the jacking limb when said limbs are deflated, and (d) tethering means connected to said outer end portions to limit movement of said outer end portions away from each other for maintaining a stable load bearing inverted V-shaped configuration.

15. Apparatus as claimed in claim 14 wherein the bag means includes a single bag having both said support and jacking limbs.

16. Apparatus as claimed in claim 14 wherein said tethering means includes flexible inelastic band means.

* * * * *